US006375765B1

(12) United States Patent
Takahashi et al.

(10) Patent No.: US 6,375,765 B1
(45) Date of Patent: Apr. 23, 2002

(54) FERRITE-BASED THIN STEEL SHEET EXCELLENT IN SHAPE FREEZING FEATURE AND MANUFACTURING METHOD THEREOF

(75) Inventors: Manabu Takahashi; Osamu Akisue, both of Futtsu; Koji Kishida, Tokai; Matsuo Usuda; Tohru Yoshida, both of Futtsu, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/509,278

(22) PCT Filed: Jul. 27, 1999

(86) PCT No.: PCT/JP99/04029

§ 371 Date: Mar. 27, 2000

§ 102(e) Date: Mar. 27, 2000

(87) PCT Pub. No.: WO00/06791

PCT Pub. Date: Feb. 10, 2000

(30) Foreign Application Priority Data

Jul. 27, 1998 (JP) ..... 10-225176

(51) Int. Cl.[7] ..... C22C 38/42
(52) U.S. Cl. ..... 148/332; 148/603
(58) Field of Search ..... 420/8, 89, 90, 420/91, 92, 93, 120, 121, 123, 124, 126, 127, 128; 148/518, 538, 540, 546, 559, 579, 332, 336, 334, 335, 601, 602, 603

(56) References Cited

U.S. PATENT DOCUMENTS 4,762,575 A * 8/1988 Sakakura et al.
5,714,017 A * 2/1998 Tomida et al. ..... 148/308
6,171,413 B1 * 1/2000 Funakawa et al. ..... 148/330

FOREIGN PATENT DOCUMENTS

JP 7-34191 2/1995
JP 9-272952 10/1997

OTHER PUBLICATIONS

"Press Forming Handbook" supervised by Seita Yoshida, published by Nikkan Kogyo Shinbunsha, 1987, pp. 417–418, with English translation of Section 8.9.4 at pp 417–418.

International Search Report, PCT/JP99/04029.

* cited by examiner

*Primary Examiner*—Roy King
*Assistant Examiner*—Harry D. Wilkins, III
(74) *Attorney, Agent, or Firm*—Kenyon & Kenyon

(57) ABSTRACT

A thin ferritic steel sheet having an excellent shape fixability capable of being used for bending is provided, comprising: at least 0.027 to less than 0.05 mass % of C, 0.01 to 1.0 mass % of Si, 0.01 to 2.0 mass % of Mn, not more than 0.15 mass % of P, not more than 0.03 mass % of S, 0.01 to 0.1 mass % of Al, not more than 0.01 mass % of N, not more than 0.007 mass % of O, the balance being Fe and inevitable impurities, wherein a ratio of presence of {100} planes parallel with a face of the steel sheet to {111} planes is not less than 1.0, and TS×El, which represents a product of maximum tensile strength (TS) multiplied by rupture elongation (El) of the steel sheet, is at least 13,860 MPA %.

18 Claims, 3 Drawing Sheets

FERRITE-BASED THIN STEEL SHEET EXCELLENT IN SHAPE FREEZING FEATURE AND MANUFACTURING METHOD THEREOF

FIELD OF THE INVENTION

The present invention relates to a ferritic steel sheet, which will be referred to as a steel sheet or a thin steel sheet hereinafter, used for making parts for automobile use, the shape fixability in bending of which is excellent due to the development of the {100} texture. Also, the present invention relates to a method for producing the ferritic steel sheet.

DESCRIPTION OF THE PRIOR ART

In order to reduce the quantity of carbonic acid gas discharged from automobiles, studies to decrease the weight of an automobile, by using high-strength steel sheets for automobile bodies, have continued. Further, in order to ensure the safety of passengers in the automobiles, not only mild steel sheets but also high-strength steel sheets are used in an automobile body. In order to further decrease the weight of an automobile body, there is an increasing demand for enhancing the strength of the high-strength steel sheets to be used for automobile bodies. However, when high-strength steel sheets are subjected to bending, a shape formed by a die in bending tends to return to its initial shape departing from the shape of the die because of the high-strength of the steel sheets. This phenomenon, in which the shape formed by the die in the bending returns to its initial shape, is referred to as spring-back. When this phenomenon of spring-back occurs, it is impossible to obtain a target shape of the part.

For the above reasons, when the conventional automobile bodies are made, only the high-strength steel sheets, the strength of which is not more than 440 MPa, have been used. Although it is necessary to decrease the weight of the automobile bodies by using the high-strength steel sheet, the strength of which is not less than 490 MPa, it is impossible to obtain high-strength steel sheets having excellent shape fixability, that is, it is impossible to obtain high-strength steel sheets on which the phenomenon of spring-back does not occur. Of course, enhancing the shape fixability, by which the shape can be kept after the completion of bending, of high-strength steel sheets and mild steel sheets, the strength of which is not more than 440 MPa, is very important for enhancing the shape accuracy of products such as automobile bodies and electric appliance bodies.

In JP-A-10-72644, there is disclosed a cold-rolled austenitic stainless steel sheet, the quantity of spring-back of which is small, characterized in that the integrated intensity of the {200} texture on a face parallel with a rolling face is not less than 1.5.

This cold-rolled austenitic stainless steel sheet is produced as follows. There is provided a continuous-cast slab, an equiaxed crystal ratio of which is not less than 30%, containing: 0.01 to 0.1 wt % of C, 0.05 to 3.0 wt % of Si, 0.05 to 2.0 wt % of Mn, not more than 0.04 wt % of P, not more than 0.03 wt % of S, not more than 0.1 wt % of Al, 15 to 25 wt % of Cr, 5 to 15 wt % of Ni, 0.005 to 0.3 wt % of N, not more than 0.007 wt % of O, the balance being Fe and inevitable impurities, or alternatively there is provided a continuous-cast slab, an equiaxed crystal ratio of which is not less than 30%, containing: 0.01 to 0.1 wt % of C, 0.05 to 3.0 wt % of Si, 0.05 to 2.0 wt % of Mn, not more than 0.04 wt % of P, not more than 0.03 wt % of S, not more than 0.1 wt % of Al, 15 to 25 wt % of Cr, 5 to 15 wt % of Ni, 0.005 to 0.3 wt % of N, not more than 0.007 wt % of O, optionally containing one of or at least two of: 0.05 to 5.0 wt % of Cu, 0.05 to 5.0 wt % of Co, 0.05 to 5.0 wt % of Mo, 0.05 to 5.0 wt % of W, 0.01 to 0.5 wt % of Ti, 0.01 to 0.5 wt % of Nb, 0.01 to 0.5 wt % of V, 0.01 to 0.5 wt % of Zr, 0.001 to 0.1 wt % of REM, 0.001 to 0.5 wt % of Y, 0.0003 to 0.01 wt % of B, and 0.0003 to 0.01 wt % of Ca, the balance being Fe and inevitable impurities. This continuous-cast slab is heated, rough-hot-rolled, finish-hot-rolled in which the finish rolling temperature at the final rolling pass is not less than 1050° C. and the rolling reduction is not less than 15%, annealed appropriately so that the hot-rolled steel sheets can be annealed, and then cold-rolled and annealed so that the cold-rolled steel sheets can be subjected to finish annealing. Due to the foregoing, the cold-rolled austenitic stainless steel sheet is produced without an increase in the crystal grain size.

However, the above cold-rolled austenitic stainless steel sheet is not used for parts of an automobile but used for a bath tubs, pans, tableware and sinks formed by press forming. Further, in the above patent publication of JP-A-10-72644, there are no descriptions about the decrease in a quantity of spring-back of the ferritic steel sheet.

SUMMARY OF THE INVENTION

Under the present conditions, when mild steel sheets and high-strength steel sheets are subjected to bending, a large quantity of spring-back is caused, depending upon the strength of the steel sheets, so that the shape fixability of the thus formed parts is deteriorated. The present invention has been accomplished to solve the above problems advantageously. It is an object of the present invention to provide a thin ferritic steel sheet, the shape fixability of which is excellent, and also it is an object of the present invention to provide a method of producing the thin ferritic steel sheet.

According to conventional knowledge, decreasing the yield point of a steel sheet is most important to suppress the occurrence of spring-back on the steel sheet. In order to use a steel sheet having a low yield point, a steel sheet having a low tensile strength must be used. However, the above countermeasure is not sufficient for enhancing the bending formability of the steel sheet and suppressing the quantity of spring-back.

In order to enhance the bending formability so that the problem of the occurrence of spring-back can be fundamentally solved, the present inventors paid attention to a phenomenon in which the texture of a steel sheet has influence on the bending formability, and made investigation into the action and effect in detail. The present inventors tried to find an appropriate material index which corresponds to the bending formability of a steel sheet. As a result of the investigation, the present inventors made the following clear. When a ratio of a {100} plane, which is parallel with a sheet face, to a {111} plane is not less than 1.0 in the texture of a steel sheet, the bending formability of the steel sheet can be improved.

In this connection, it can be assumed that a quantity of presence of the crystal plane parallel with the surface of a thin steel sheet is proportional to a quantity of diffraction of X-ray. Therefore, the quantity of presence of the crystal plane parallel with the surface of a thin steel sheet is found by measuring the X-ray diffraction intensities of the {200} and the {222} plane. Accordingly, the X-ray diffraction intensity on a {200} plane and that on a {222} plane respectively correspond to the quantity of presence of {100} planes and that of {111} planes. Of course, it is possible to say that the ratio of X-ray diffraction intensity {200}/{222}, is equal to the ratio of X-ray diffraction intensity, {100}/{111}, both the {100} plane and the {111} plane of which exist as crystal planes.

The present invention has been accomplished on the basis of the above knowledge. The thin ferritic steel sheet of the present invention is summarized as described in the following items (1) to (10).

(1) A thin ferritic steel sheet having an excellent shape fixability characterized in that a ratio of presence of {100} planes parallel with sheet surface to {111} planes is not less than 1.0, and TS×El, which represents a product of maximum tensile strength (TS) multiplied by rupture elongation (El) of the steel sheet, is at least 13,860 MPa %.

(2) A thin ferritic steel sheet having an excellent shape fixability, comprising: at least 0.027 to less than 0.05 mass % of C, 0.01 to 1.0 mass % of Si, 0.01 to 2.0 mass % of Mn, not more than 0.15 mass % of P, not more than 0.03 mass % of S, 0.01 to 0.1 mass % of Al, not more than 0.01 mass % of N, not more than 0.007 mass % of O, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

(3) A thin ferritic steel sheet having an excellent shape fixability, comprising: at least 0.027 to less than 0.05 mass % of C, 0.01 to 1.0 mass % of Si, 0.01 to 2.0 mass % of Mn, not more than 0.15 mass % of P, not more than 0.03 mass % of S, 0.01 to 0.1 mass % of Al, not more than 0.01 mass % of N, not more than 0.007 mass % of O, further containing one of or at least two of not more than 0.2 mass % of Ti, not more than 0.2 mass % of Nb and not more than 0.005 mass % of B, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

(4) A thin ferritic steel sheet having an excellent shape fixability, comprising: at least 0.027 to less than 0.05 mass % of C, 0.01 to 1.0 mass % of Si, 0.01 to 2.0 mass % of Mn, not more than 0.15 mass % of P, not more than 0.03 mass % of S, 0.01 to 0.1 mass % of Al, not more than 0.01 mass % of N, not more than 0.007 mass % of O, further containing one of or at least two of not more than 1.0 mass % of Mo, not more than 2.0 mass % of Cu and not more than 1.0 mass % of Ni, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

(5) A thin ferritic steel sheet having an excellent shape fixability, comprising: at least 0.027 to less than 0.05 mass % of C, 0.01 to 1.0 mass % of Si, 0.01 to 2.0 mass % of Mn, not more than 0.15 mass % of P, not more than 0.03 mass % of S, 0.01 to 0.1 mass % of Al, not more than 0.01 mass % of N, not more than 0.007 mass % of O, further containing one of or at least two of not more than 0.2 mass % of Ti, not more than 0.2 mass % of Nb and not more than 0.005 mass % of B, furthermore containing one of or at least two of not more than 1.0 mass % of Mo, not more than 2.0 mass % of Cu and not more than 1.0 mass % of Ni, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

(6) A thin ferritic steel sheet having an excellent shape fixability, comprising: 0.05 to 0.25 mass % of C, 0.01 to 2.5 mass % of Si, 0.01 to 2.5 mass % of Mn, not more than 0.15 mass % of P, not more than 0.03 mass % of S, 0.01 to 1.0 mass % of Al, not more than 0.01 mass % of N, not more than 0.007 mass % of O, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

(7) A thin ferritic steel sheet having an excellent shape fixability, comprising: 0.05 to 0.25 mass % of C, 0.01 to 2.5 mass % of Si, 0.01 to 2.5 mass % of Mn, not more than 0.15 mass % of P, not more than 0.03 mass % of S, 0.01 to 1.0 mass % of Al, not more than 0.01 mass % of N, not more than 0.007 mass % of O, further containing one of or at least two of not more than 0.2 mass % of Ti, not more than 0.2 mass % of Nb, not more than 0.2 mass % of V, not more than 1.0 mass % of Cr and not more than 0.005 mass % of B, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

(8) A thin ferritic steel sheet having an excellent shape fixability, comprising: 0.05 to 0.25 mass % of C, 0.01 to 2.5 mass % of Si, 0.01 to 2.5 mass % of Mn, not more than 0.15 mass % of P, not more than 0.03 mass % of S, 0.01 to 1.0 mass % of Al, not more than 0.01 mass % of N, not more than 0.007 mass % of O, further containing one of or at least two of not more than 1.0 mass % of Mo, not more than 2.0 mass % of Cu and not more than 1.0 mass % of Ni, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

(9) A thin ferritic steel sheet having an excellent shape fixability, comprising: 0.05 to 0.25 mass % of C, 0.01 to 2.5 mass % of Si, 0.01 to 2.5 mass % of Mn, not more than 0.15 mass % of P, not more than 0.03 mass % of S, 0.01 to 1.0 mass % of Al, not more than 0.01 mass % of N, not more than 0.007 mass % of O, further containing one of or at least two of not more than 0.2 mass % of Ti, not more than 0.2 mass % of Nb, not more than 0.2 mass % of V, not more than 1.0 mass % of Cr and not more than 0.005 mass % of B, furthermore containing one of or at least two of not more than 1.0 mass % of Mo, not more than 2.0 mass % of Cu and not more than 1.0 mass % of Ni, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

(10) A thin ferritic steel sheet having an excellent shape fixability, according to one of items (1) to (9), wherein the sheet surface is plated.

The method of producing a thin ferritic steel sheet having an excellent shape fixability of the present invention is described in the following items (11) to (18).

(11) A method of producing a thin ferritic steel sheet having an excellent shape fixability according to one of the items (1) to (9), comprising the steps of: conducting hot-rolling on a slab of a predetermined composition so that a total rolling reduction of 25% or more in the hot rolling conducted at a temperature range from a temperature not higher than 950° C. to a temperature not lower than transformation temperature $Ar_3$ and a coefficient of friction of 0.2 or less in the hot rolling conducted at a temperature not higher than 950° C.; completing the hot rolling at a temperature not lower than transformation temperature $Ar_3$; cooling the hot-rolled steel strip; and coiling the hot-rolled steel strip at a temperature not higher than critical temperature $T_0$ determined by the following expression.

$$T_0 = -650.4 \times C\% - 50.6 \times Mneq + 894.3$$

where $$Mneq = Mn\% + 0.5 \times Ni\% - 1.49 \times Si\% - 1.05 \times Mo\% - 0.44 \times W\% + 0.37 \times Cr\% + 0.67 \times Cu\% - 23 \times P\% + 13 \times Al\%$$

(12) A method of producing a thin ferritic steel sheet having an excellent shape fixability according to item (10), comprising the steps of: conducting hot-rolling on a slab of a predetermined composition so that a total rolling reduction of 25% or more in the hot rolling conducted at temperature range from a temperature not higher than 950° C. to a temperature not lower than transformation temperature $Ar_3$ and a coefficient of friction of 0.2 or less in the hot rolling conducted at a temperature not higher than 950° C.; completing the hot rolling at a temperature not lower than transformation temperature $Ar_3$; cooling the hot-rolled steel strip; coiling the hot-rolled steel strip at a temperature not higher than critical temperature $T_0$ determined by the following expression; and plating on the hot-rolled steel strip.

$$T_0 = -650.4 \times C\% - 50.6 \times Mneq + 894.3$$

where $$Mneq = Mn\% + 0.5 \times Ni\% - 1.49 \times Si\% - 1.05 \times Mo\% - 0.44 \times W\% + 0.37 \times Cr\% + 0.67 \times Cu\% - 23 \times P\% + 13 \times Al\%$$

(13) A method of producing a thin ferritic steel sheet having an excellent shape fixability according to one of the items (1) to (9), comprising the steps of: conducting hot-rolling on a slab of a predetermined composition so that a total rolling reduction of 25% or more in the hot rolling conducted at a temperature not higher than transformation temperature $Ar_3$ and a coefficient of friction of 0.2 or less in the hot rolling conducted at a temperature not higher than the $Ar_3$; cooling the hot-rolled steel strip; and coiling the hot-rolled strip or additionally recovering and recrystallizing the hot-rolled steel strip.

(14) A method of producing a thin ferritic steel sheet having an excellent shape fixability according to item (10), comprising the steps of: conducting hot-rolling on a slab of a predetermined composition so that a total rolling reduction of 25% or more in the hot rolling conducted at a temperature not higher than transformation temperature $Ar_3$ and a coefficient of friction of 0.2 or less in the hot rolling conducted at a temperature not higher that the $Ar_3$; cooling the hot-rolled steel strip; coiling the hot-rolled steel strip or additionally recovering and recrystallizing the hot-rolled steel strip; and plating on the hot-rolled steel strip.

(15) A method of producing a thin ferritic steel sheet having an excellent shape fixability according to one of the items (1) to (9), comprising the steps of: conducting hot-rolling on a slab of a predetermined composition so that a total rolling reduction of 25% or more in the hot rolling conducted at a temperature range from a temperature not higher than 950° C. to a temperature not lower than transformation temperature $Ar_3$ and a coefficient of friction of 0.2 or less in the hot rolling conducted at a temperature not higher than 950° C.; completing the hot rolling at a temperature not lower than transformation temperature $Ar_3$; cooling the hot-rolled steel strip; coiling the hot-rolled steel strip at a temperature not higher than critical temperature $T_0$ determined by the following expression; pickling the hot-rolled steel strip; conducting cold-rolling on the steel strip at a rolling reduction lower than 80%; heating the cold-rolled steel strip in a temperature range from a temperature not lower than 600° C. to a temperature lower than transformation temperature $Ac_3$; and cooling the steel strip.

$$T_0 = -650.4 \times C\% - 50.6 \times Mneq + 894.3$$

where $$Mneq = Mn\% + 0.5 \times Ni\% - 1.49 \times Si\% - 1.05 \times Mo\% - 0.44 \times W\% + 0.37 \times Cr\% + 0.67 \times Cu\% - 23 \times P\% + 13 \times Al\%$$

(16) A method of producing a thin ferritic steel sheet having an excellent shape fixability according to item (10), comprising the steps of: conducting hot-rolling on a slab of a predetermined composition so that a total rolling reduction of 25% or more in the hot rolling conducted at a temperature range from a temperature not higher than 950° C. to a temperature not lower than transformation temperature $Ar_3$ and a coefficient of friction of 0.2 or less in the hot rolling conducted at a temperature not higher than 950° C.;

completing the hot rolling at a temperature not lower than transformation temperature $Ar_3$; cooling the hot-rolled steel strip; coiling the hot-rolled steel strip at a temperature not higher than critical temperature $T_0$ determined by the following expression; pickling the hot-rolled steel strip; conducting cold-rolling on the steel strip at a rolling reduction lower than 80%; heating the cold-rolled steel strip in a temperature range from a temperature not lower than 600° C. to a temperature lower than transformation temperature $AC_3$; cooling the steel strip; and plating on the steel strip.

$$T_0 = -650.4 \times C\% - 50.6 \times Mneq + 894.3$$

where $$Mneq = Mn\% + 0.5 \times Ni\% - 1.49 \times Si\% - 1.05 \times Mo\% - 0.44 \times W\% + 0.37 \times Cr\% + 0.67 \times Cu\% - 23 \times P\% + 13 \times Al\%$$

(17) A method of producing a thin ferritic steel sheet having an excellent shape fixability according to one of the items (1) to (9), comprising the steps of: conducting hot-rolling on a slab of a predetermined composition so that a total rolling reduction of 25% or more in the hot rolling conducted at a temperature not higher than transformation temperature $Ar_3$ and a coefficient of friction of 0.2 or less in the hot rolling conducted at a temperature not higher than the $Ar_3$; cooling the hot-rolled steel strip; and coiling the hot-rolling steel strip or additionally recovering and recrystallizing the hot-rolling steel strip; pickling the hot-rolled steel strip; conducting cold-rolling on the steel strip at a rolling reduction lower than 80%; heating the cold-rolled steel strip in a temperature range from a temperature not lower than 600° C. to a temperature lower than transformation temperature $Ac_3$; and cooling the steel strip.

(18) A method of producing a thin ferritic steel sheet having an excellent shape fixability according to item (10), comprising the steps of: conducting hot-rolling on a slab of a predetermined composition so that a total rolling reduction of 25% or more in the hot rolling conducted at a temperature not higher than transformation temperature $Ar_3$ and a coefficient of friction of 0.2 or less in the hot rolling conducted at a temperature not higher than transformation temperature $Ar_3$; cooling the hot-rolled steel strip; and coiling the hot-rolled steel strip or additionally recovering and recrystallizing the hot-rolled steel strip; pickling the hot-rolled steel strip; conducting cold-rolling on the steel strip at a rolling reduction lower than 80%; heating the cold-rolled steel strip in a temperature range from a temperature not lower than 600° C. to a temperature lower than transformation temperature $Ac_3$; cooling the steel strip; and plating on the steel strip.

THE MOST PREFERRED EMBODIMENT

Figure 1:
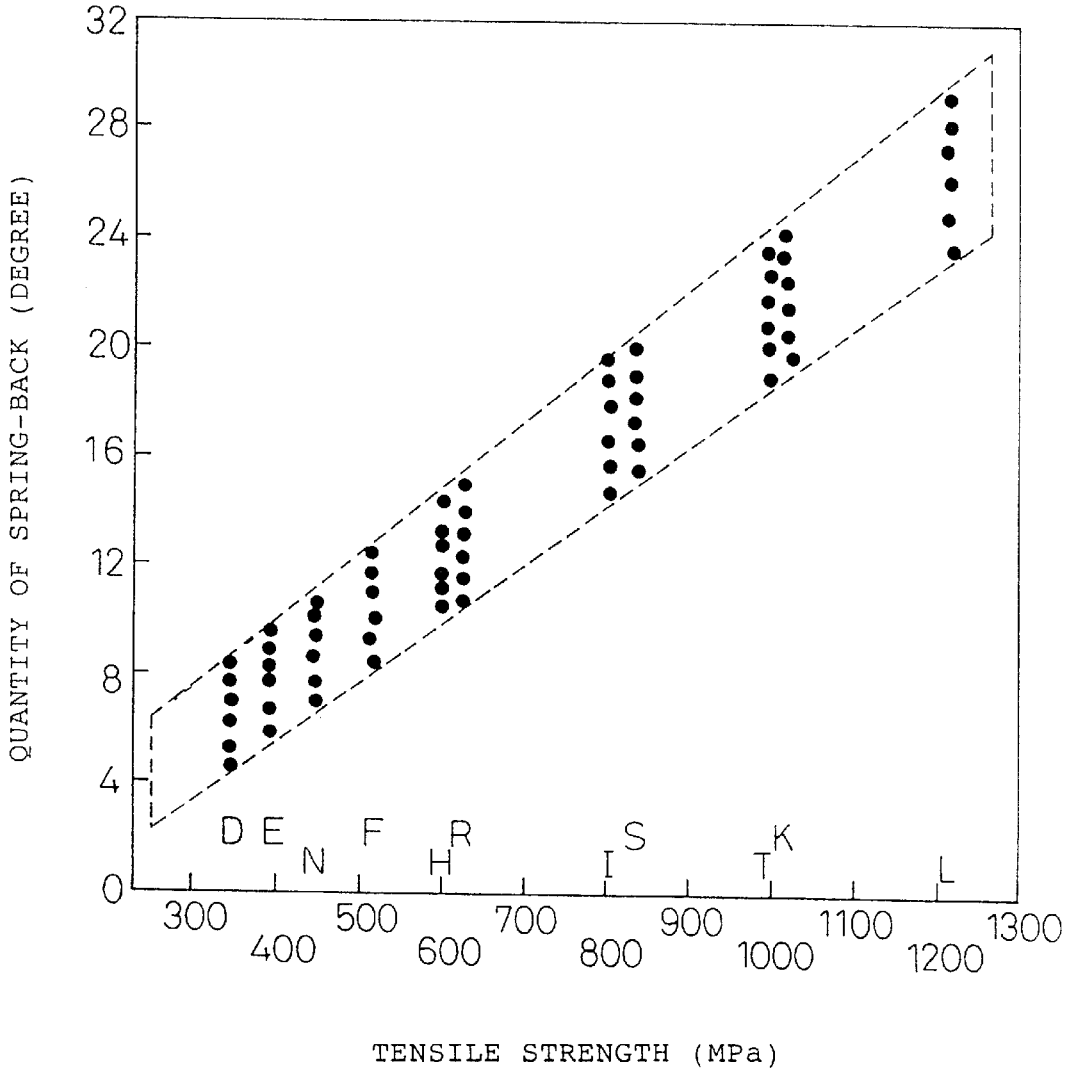
FIG. 1 is a graph showing a relationship between the tensile strength of a cold-rolled steel sheet and the quantity of spring-back.

The fundamental principle of the present invention is that the bending formability of a thin steel sheet is greatly enhanced when a ratio of presence of a {100} plane, which is parallel with a face of a thin steel sheet, to a {111} plane, (i.e., a ratio of the X-ray diffraction intensity) is not less than 1.0. The reason why this ratio of presence is restricted is described as follows.

First, the reason why the ratio of presence of a {100} plane to a {111} plane is restricted to be not less than 1.0 is that when this ratio is lower than 1.0, a quantity of spring-back of a thin steel sheet is greatly increased in the process of bending the thin steel sheet. The reason why the quantity of spring-back of a thin steel sheet is greatly decreased when this ratio of presence of the crystal plane is not less than 1.0 is considered to be that plastic deformation in the steel sheet is very smoothly conducted in the process of bending. When bending deformation is studied from the viewpoint of crystallography, it seems that when a large number of {100} planes exist in steel, bending deformation can be conducted only by a simple slip system. On the other hand, when a large number of {111} planes exist in steel, a plurality of complicated slip systems act in steel in the process of bending. In other words, it seems that the presence of {111} planes is unnecessary for the deformation conducted by bending. Due to the foregoing, it can be understood that the bending deformation can be smoothly conducted when a quantity of presence of {100} planes becomes larger than that of {111} planes and the ratio is increased to a value not less than 1.0.

In this case, the following is important. With respect to all thin steel sheets ranging from a mild steel sheet of low strength to a steel sheet of high-strength, when the ratio of presence of a {100} plane, which is parallel with a face of a thin steel sheet, to a {111} plane is not less than 1.0, the bending formability of the thin steel sheet can be greatly enhanced. In other words, the aforementioned ratio is a fundamental material index of the bending formability which exceeds the restriction of the level of strength of a thin steel sheet.

The above concept can be applied to all types of thin steel sheets, that is, the type of a thin steel sheet is not particularly limited. However, from the viewpoint of practical use, this technique can be applied to all types of steel sheets ranging from mild steel sheets to steel sheets of high-strength. Of course, this technique can be applied to both hot-rolled steel sheets and cold-rolled steel sheets.

The effect of the present invention can be provided when the ratio of presence of a {100} plane, which is parallel with a face of a thin steel sheet, to a {111} plane is not less than 1.0. However, in order to provide a more remarkable effect, it is preferable that the ratio of presence is not less than 1.5.

Next, the composition system of the thin ferritic steel sheet described in items (2) to (9) will be explained below.

The composition system of the thin ferritic steel sheet described in items (2) to (9) includes: low carbon steel sheet; high-strength steel sheet strengthened by solid solution; high-strength steel sheet strengthened by precipitation; high-strength steel sheet strengthened by a transformed phase or by transformed phases such as martensite, pearlite and bainite, etc.; and high-strength steel sheet in which the above strengthening mechanisms are utilized being compounded.

Objects of the composition system of the thin ferritic steel sheet described in item (2) are mainly low carbon steel sheet and high-strength steel sheet, the strength of which is enhanced by solid solution. Objects of the composition system of the thin ferritic steel sheet described in item (3) are mainly an interstitial free steel sheet and high-strength steel sheet, the strength of which is enhanced by precipitation. Objects of the composition system of a ferritic steel sheet described in item (6) are mainly a high-strength steel sheet strengthened by the transformation microstructure. Objects of the composition system of a ferritic steel sheet described in item (7) are steel sheets in which the high-strength steel sheet strengthened by solid solution or the high-strength steel sheet strengthened by the transformation microstructure is combined with the precipitation strengthening mechanism.

The reasons why the compositions of thin ferritic steel sheets described in items (2) to (5) are restricted will be explained as follows.

The reason why the lower limit of C content is set at 0.027% is that this is the lower limit of C content which gives a sufficient strength. When C content exceeds the upper limit of 0.05%, the formability is deteriorated. Therefore, the upper limit of C content is set at 0.05%.

Si and Mn are elements necessary for deoxidation. Therefore, it is necessary for Si and Mn to be respectively contained at not less than 0.01%. However, the reason why the contents of Si and Mn are respectively set at a value not more than 1.0% and a value not more than 2.0% is that the formability is deteriorated when the contents exceed the above values.

The contents of P and S are respectively set at a value not more than 0.15% and a value not more than 0.03%. The upper limits of P and S are respectively set at the above values for preventing the formability from deteriorating.

Al is added for deoxidation at not less than 0.01%. However, when an excessively large quantity of Al is added, the formability is deteriorated. Therefore, the upper limit of Al is set at 0.1%.

N and O are impurities. In order to prevent the deterioration of the formability, the contents of N and O are respectively kept at values not more than 0.01% and 0.007%.

Ti, Nb and B are elements to improve the material via the mechanisms of fixation of carbon and nitrogen, precipitation strengthening and making the particles fine. Therefore, it is preferable that Ti, Nb and B are respectively added to steel at not less than 0.005%, 0.001% and 0.0001%. However, when these elements are excessively added to steel, the formability is deteriorated. Therefore, the upper limits are respectively set at 0.2%, 0.2% and 0.005%.

In order to ensure the mechanical strength of steel, it is preferable that Mo, Cu and Ni are added by not less than 0.001%, 0.001% and 0.001%. However, when these elements are excessively added to steel, the formability is deteriorated. Therefore, the upper limits are respectively set at 1.0%, 2.0% and 1.0%.

The reasons why the compositions of thin ferritic steel sheets described in items (6) to (9) are restricted will be explained as follows.

The reason why the lower limit of C content is set at 0.05% is that the lower limit of C content of practically used steel is used here. When C content exceeds the upper limit of 0.25%, the formability and the weldability are deteriorated. Therefore, the upper limit of C content is set at 0.25%.

Si and Mn are elements necessary for deoxidation. Therefore, it is necessary for Si and Mn to be respectively contained by not less than 0.01%. However, the reason why the contents of both Si and Mn are set at a value not more than 2.5% is that the formability is deteriorated when the contents exceed the above value.

The contents of P and S are respectively set at a value not more than 0.15% and a value not more than 0.03%. The upper limits of P and S are respectively set at the above values to prevent the formability from deteriorating.

Al is added at not less than 0.01% for the object of deoxidation and material control. However, when Al is excessively added, the surface property of a steel sheet is deteriorated. Therefore, the upper limit is set at 1.0%.

N and O are impurities. In order to prevent the deterioration of the formability, the contents of N and O are respectively kept at values not more than 0.01% and 0.007%.

Ti, Nb, V, Cr and B are elements to improve the material via the mechanisms of fixation of carbon and nitrogen, precipitation strengthening, controlling the structure and facilitating the particles to be fine. Therefore, it is preferable that Ti, Nb, V, Cr and B are respectively added to steel at not less than 0.005%, 0.001%, 0.001%, 0.01% and 0.0001%. However, when these elements are excessively added to steel, the formability is deteriorated. Therefore, the upper limits are respectively set at 0.2%, 0.2%, 0.2%, 1.0% and 0.005%.

In order to ensure the mechanical strength of steel, it is preferable that Mo, Cu and Ni are added at not less than 0.001%, 0.001% and 0.001% respectively. However, when these elements are excessively added to steel, the formability is deteriorated. Therefore, the upper limits are respectively set at 1.0%, 2.0% and 1.0%.

The type of plating conducted on the ferritic steel sheet described in item (10) is not particularly limited, that is, any type of plating such as electroplating, hot-dip plating and vapor-deposition plating can be applied to the ferritic steel sheet described in item (10) and the effect of the present invention can be provided.

In this connection, the steel sheets of the present invention can be applied to not only bending but also punch-stretch forming and drawing.

Next, the method of producing a ferritic steel sheet having a high shape fixability of the present invention will be described below.

According to the method of producing a ferritic steel sheet having a high shape fixability of the present invention, after steel of the above composition has been cast to a slab, the slab is subjected to the following fundamental processes.

(1) After the slab has been hot-rolled, the hot strip is coiled at a predetermined temperature.

(2) After the slab has been hot-rolled, the hot strip is cooled. Alternatively, after the hot strip has been cooled, it is heat-treated.

Alternatively, the slab is subjected to the following process.

(3) After the slab has been hot-rolled as described in item (1) or (2), the hot strip is cooled, pickled in an acid bath, cold-rolled and annealed.

(4) The hot strip obtained by process (1) or (2), or the cold strip obtained by process (3) is heat-treated in a hot-dip plating line. In this connection, it is possible to add a process for conducting another surface treatment on these steel strips.

In this case, the reasons why the various conditions are restricted in the method of producing a steel sheet of the present invention will be explained as follows.

When hot rolling is completed at a temperature not lower than transformation temperature $Ar_3$ which is determined by the chemical composition of steel, in the case where hot rolling is not conducted in the latter half of hot rolling by a rolling reduction of not less than 25% at a temperature not higher than 950° C., it is difficult for the rolled austenitic texture to be developed sufficiently. As a result, even when cooling is conducted on the steel strip by all methods, on a face of the finally obtained hot strip, a ratio {200}/{222} of X-ray diffraction intensity on a crystal plane parallel with a face of the steel strip can not be increased to a value not less than 1.0. Therefore, the lower limit of the total rolling reduction in hot rolling conducted at a temperature not higher than 950° C. is set at 25%. The higher the total rolling reduction is in hot rolling conducted at a temperature not higher than 950° C. and not lower than transformation temperature $Ar_3$, the sharper the texture that can be formed. When this total rolling reduction exceeds 97.5%, it becomes necessary to excessively increase the rigidity of the hot rolling mill, which is disadvantageous from the economical viewpoint. Therefore, it is preferable that the total rolling reduction is not more than 97.5%.

In this case, when a coefficient of friction between the hot rolling rolls and the steel strip exceeds 0.2 in the hot rolling process conducted in a temperature range from a temperature not higher than 950° C. to transformation temperature $Ar_3$, the ratio {200}/{222} of X-ray diffraction intensity sent from the crystal plane parallel with a face of steel strip close to the surface of the steel strip can not be a value not lower than 1.0, that is, the shape fixability of the steel sheet is deteriorated. Therefore, the upper limit of the coefficient of friction between the hot rolling roller and the steel strip in the process of hot rolling conducted in a temperature range from not higher than 950° C. to not lower than transformation temperature $Ar_3$ is set at 0.2. It is preferable that this coefficient of friction is low. Especially when the requirement for the shape fixability is severe, it is preferable that this coefficient of friction is not higher than 0.15.

In order to succeed the austenitic texture formed in this way by the final structure of the hot steel strip, it is necessary to coil the hot steel strip at a temperature not higher than temperature $T_0$ defined as follows. Therefore, temperature $T_0$ determined by the composition of steel is determined to be the upper limit of the coiling temperature. This temperature $T_0$ is thermodynamically defined as a temperature at which austenite and ferrite, the composition of which is the same as that of austenite, have the same free energy. Considering effects of components, except C, $T_0$ can be simply calculated by the following expression (1). In this connection, the influence of components not stipulated in the present invention is not large and the influence of such components is neglected here.

$$T_0=-650.4\times C\%+B \quad (1)$$

In this case, B is determined by the chemical composition (mass %) of steel and defined as follows.

$$B=-50.6\times Mneq+894.3$$

$$Mneq=\mathrm{Mn}\%+0.5\times\mathrm{Ni}\%-1.49\times\mathrm{Si}\%-1.05\times\mathrm{Mo}\%-0.44\times W\%+0.37\times\mathrm{Cr}\%+0.67\times\mathrm{Cu}\%-23\times P\%+13\times\mathrm{Al}\%$$

In the case where hot rolling is conducted at a temperature not higher than transformation temperature $Ar_3$ determined by the chemical composition of steel, ferrite created before rolling is rolled. As a result, a strong rolling texture can be formed. In order to finally change this texture into a texture which is advantageous for enhancing the shape fixability, it is necessary to heat the ferrite again after the hot strip has been coiled in the process of cooling or after the hot strip has been once cooled, so that the ferrite can be recovered and recrystallized.

When a total rolling reduction is lower than 25% at a temperature not higher than $Ar_3$ transformation temperature, even if the steel strip is coiled at a temperature not lower than the recrystallization temperature and even if the steel strip is reheated after cooling so as to be recovered and recrystallized, a ratio {200}/{222} of X-ray diffraction intensity sent from the crystal plane parallel with a face of the steel sheet cannot be increased to a value not lower than 1.0. Therefore, the lower limit of the total rolling reduction in hot rolling conducted at a temperature not higher than transformation temperature $Ar_3$ is set at 25%. When a coefficient of friction between the hot rolling roller and the steel strip exceeds 0.2 in the hot rolling process, the ratio {200}/{222} of X-ray diffraction intensity sent from the crystal plane parallel with a face of steel strip close to the surface of the steel strip cannot be a value not lower than 1.0. Therefore, the upper limit of the coefficient of friction between the hot rolling rolls and the steel strip in the process of hot rolling conducted at a temperature not higher than transformation temperature $Ar_3$ is set at 0.2. It is preferable that this coefficient of friction is low. Especially when the requirement for the shape fixability is severe, it is preferable that this coefficient of friction is not higher than 0.15.

When the thus obtained hot-rolled steel sheet (or the heat-treated hot-rolled steel sheet) is cold-rolled and annealed so as to make a final product of a thin steel sheet, in the case where a total rolling reduction of cold rolling is not lower than 80%, on a face of the steel sheet, the texture of which is a common cold rolling-recrystallization texture, a component of {222} planes in the ratio of intensity of integration face of X-ray diffraction on the crystal plane parallel with the face of the steel sheet is increased. Therefore, the ratio {200}/{222}, which is the characteristic parameter of the present invention, becomes lower than 1.0. Therefore, the upper limit of the total rolling reduction of cold rolling is set at a value lower than 80%. In this connection, in order to enhance the shape fixability of a steel sheet, it is preferable that the total rolling reduction is restricted to be not higher than 70%.

In the case where a cold-rolled steel sheet, which is cold-rolled at the total rolling reduction described above, is annealed, when the annealing temperature is lower than 600° C., the structure existing in the steel sheet in the process of cold rolling remains even after the completion of annealing, and the formability is greatly deteriorated. Therefore, the lower limit of the annealing temperature is set at 600° C. On the other hand, when the annealing temperature is excessively high, the ferritic texture created by recrystallization transforms into austenitic texture and then, the austenitic texture becomes random by the growth of austenite grains. Therefore, the finally obtained ferritic texture also becomes random. Especially when the annealing temperature is not lower than transformation temperature $Ac_3$, the finally obtained ratio of {200}/{222} does not exceed 1.0. Therefore, the upper limit of the annealing temperature is set at a value lower than transformation temperature $Ac_3$.

EXAMPLES

Referring to the examples of the present invention, the technical contents of the present invention will be explained below.

As the examples, there were provided several types of steel from A to X, the chemical compositions of which are shown on Table 1. These types of steel were cast into slabs. Immediately after the completion of casting of the slabs or after the slabs had been once cooled to room temperature, they were heated again into a temperature range from 900° C. to 1300° C. After that, the slabs were hot-rolled and finally made into hot-rolled steel sheets, the thicknesses of which were 1.4 mm, 3.0 mm and 8.0 mm. The hot-rolled steel sheets, the thicknesses of which were 3.0 mm and 8.0 mm, were cold-rolled and made to be cold-rolled steel sheets, the thicknesses of which were 1.4 mm. After that, the cold-rolled steel sheets were annealed in the continuous annealing process, for example, the cold-rolled steel sheets were continuously annealed at 700 to 850° C. Test pieces of these cold-rolled steel sheets of 1.4 mm thickness were subjected to a bending test, in which the test pieces were bent by 90°, according to the U-shape-bending test method described on pages 417 to 418 of "Press Forming Handbook" supervised by Seita Yoshida published by Nikkan Kogyo Shinbunsha in 1987, and the shape fixability was evaluated by a value obtained when 90° was subtracted from the opening angle, that is, the shape fixability was evaluated by the quantity of spring-back.

It is commonly said that the lower the yield point and the tensile strength are, the smaller the quantity of the spring-back becomes. This tendency can be confirmed by FIG. 1 which shows the results of measurement of the quantities of spring-back of cold-rolled steel sheets which were made by various production methods with respect to chemical compositions (D, E, F, H, I, K, L, N, R, S and T) shown on Table 1.

Figure 2:
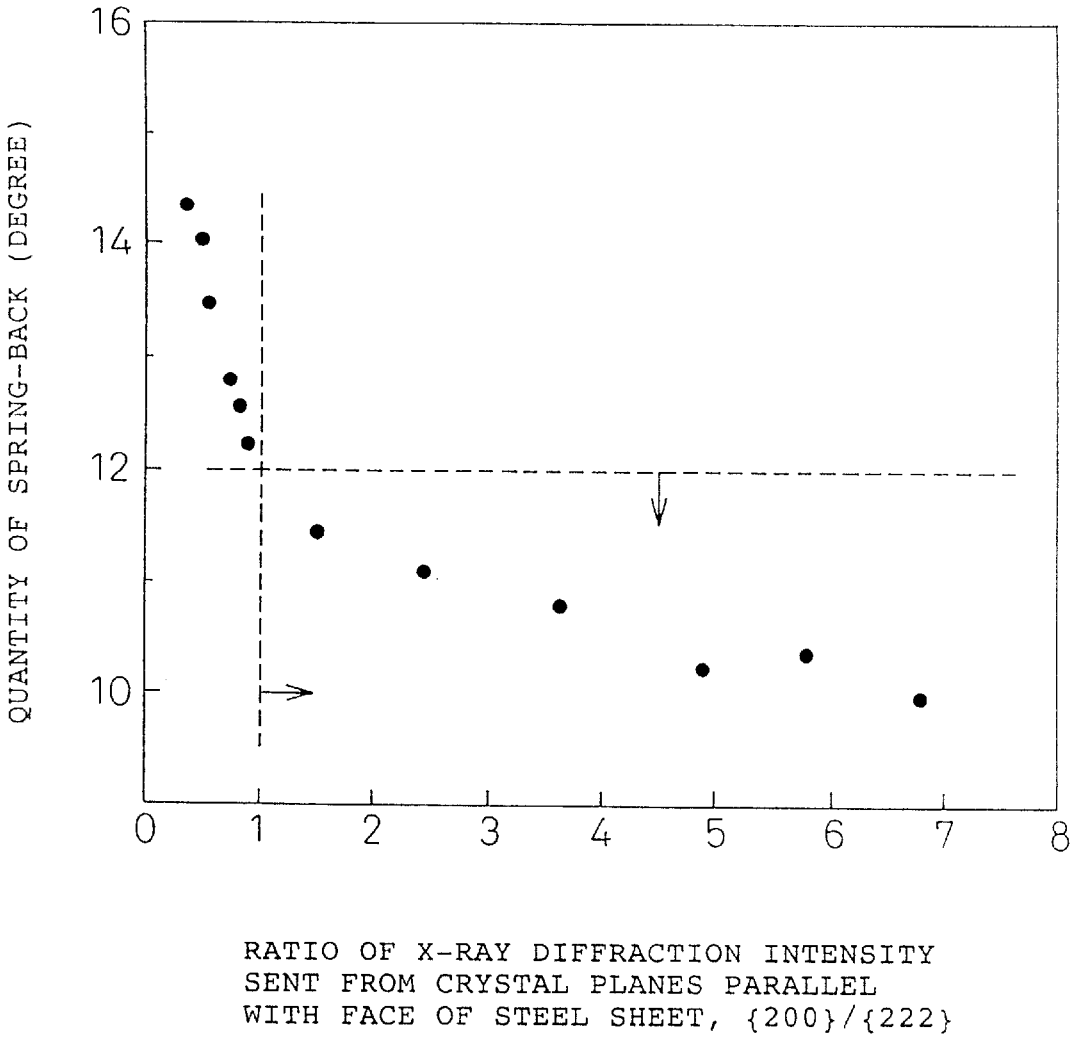
FIG. 2 is a graph showing a relationship between the ratio {200}/{222} of X-ray diffraction intensity of a cold-rolled steel sheet, the tensile strength of 590 MPa, and the quantity of spring-back.

In this case, the present inventors made investigation into the effects of the texture for the quantities of spring-back of the cold-rolled steel sheets. An example of the result is shown in FIG. 2. This is the result of the investigation made into H-shape steel having a strength of about 590 MPa. As can be seen in FIG. 2, the higher the ratio {200}/{222} of X-ray diffraction intensity sent from a crystal plane parallel with a face of a steel sheet is, the smaller the quantity of spring-back becomes. Especially, when the ratio becomes higher than 1.0, the effect becomes more remarkable. That is, in the present invention, the present inventors discovered that a very fundamental and general relationship exists between the texture and the quantity of spring-back.

Figure 3:
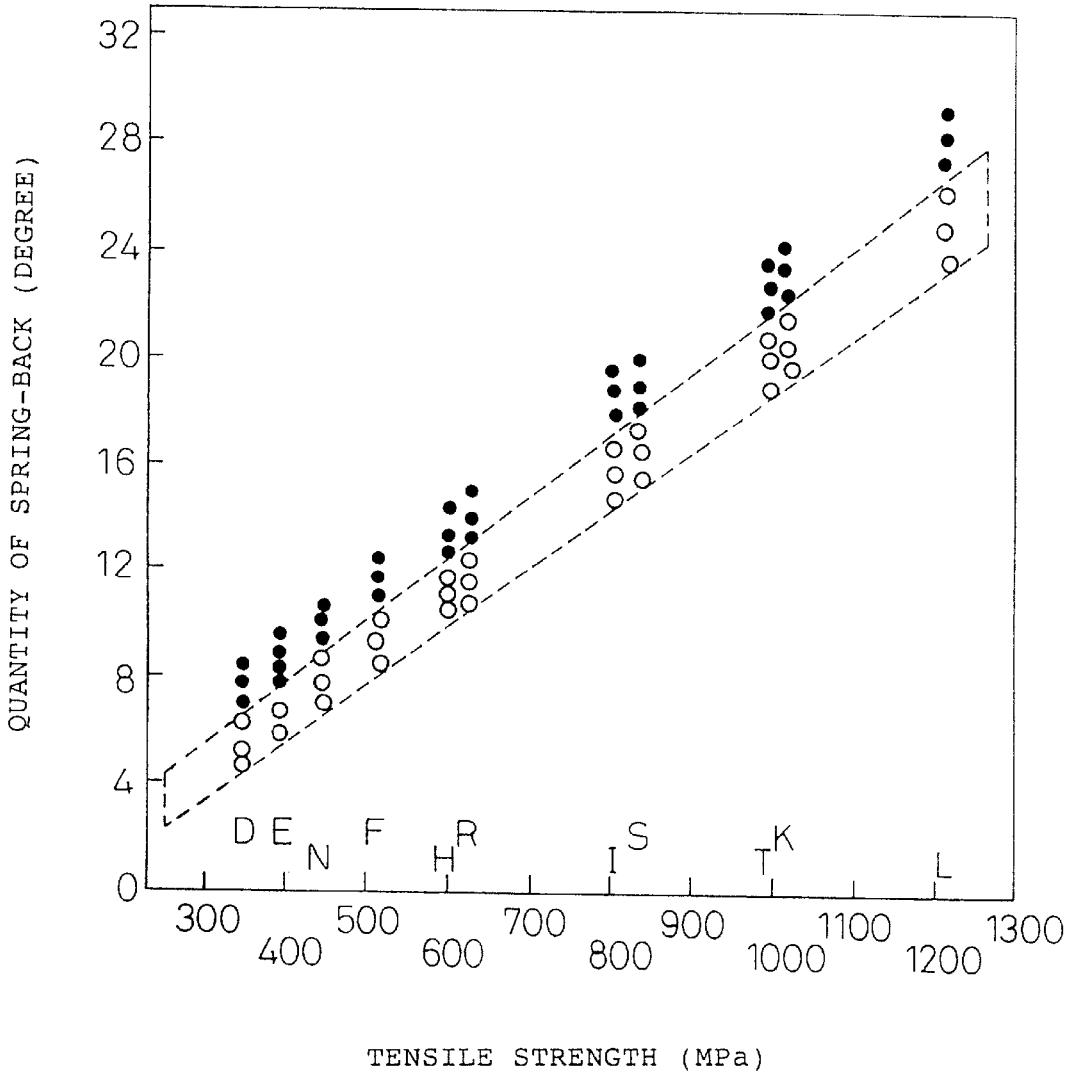
FIG. 3 is a graph showing a relationship between the tensile strength of a cold-rolled steel sheet and the effect of the ratio {200}/{222} of X-ray diffraction intensity having influence on a quantity of spring-back of the cold-rolled steel sheet.

FIG. 3 is a graph showing a result of classification in which the quantities of spring-back of various cold-rolled steel sheets shown in FIG. 1 are classified by the boundary value of 1.0 of the ratio {200}/{222} of X-ray diffraction intensity. In FIG. 3, mark ● represents a quantity of spring-back relating to a steel sheet, the value {200}/{222} of which is lower than 1.0, and mark ○ represents a quantity of spring-back relating to a steel sheet, the value {200}/{222} of which is not lower than 1.0. As can be seen on this graph, concerning all the cold-rolled steel sheets, when the ratio {200}/{222} of X-ray diffraction intensity is not lower than 1.0, the quantities of spring-back become very small irrespective of the level of the strength. With respect to the ratio of crystal planes, when the ratio of {100}/{111} is increased, the quantity of sprig-back can be effectively suppressed.

On Table 2, there are shown mechanical characteristic values and quantities of spring-back of the hot-rolled steel sheets of 1.4 mm thickness and cold-rolled steel sheets of 1.4 mm thickness produced by the above method. On Table 3, it is shown whether or not the conditions of producing the steel sheets are in the scope of the present invention. On Table 3, the column "Hot rolling temperature 1", represents the following. In the column of "Hot rolling temperature 1", mark ○ represents a case in which the hot-rolling is completed at a temperature not lower than transformation temperature $Ar_3$, and a total rolling reduction in the hot-rolling conducted in a temperature range from not higher than 950° C. to not lower than transformation temperature $Ar_3$ is not less than 25%. On Table 3, in the column of "Hot rolling temperature 2", mark ○ represents a case in which the hot-rolling is conducted at a temperature not higher than transformation temperature $Ar_3$, and a total rolling reduction at a temperature not higher than transformation temperature $Ar_3$ is not less than 25%. In any case, in the column of "Lubrication" on Table 3, mark ○ represents a case in which the coefficient of friction is not more than 0.2 in the temperature range, and mark × represents a case in which the coefficient of friction exceeds 0.2 in the temperature range. In the hot rolling, the coiling temperature was set at a value not higher than temperature $T_0$ determined by the above expression (1). In the case where the hot-rolled steel sheet was subjected to cold-rolling so as to produce a cold-rolled steel sheet of 1.4 mm thickness, in the column of "rolling reduction of cold-rolling" on Table 3, mark × represents a case in which the rolling reduction of cold-rolling is not less than 80%, and mark ○ represents a case in which the rolling reduction of cold-rolling is lower than 80%. On Table 3, in the column of "Annealing temperature", mark ○ represents a case in which the annealing temperature is in a temperature range from a temperature not lower than 600° C. to a temperature lower than transformation temperature $Ac_3$, and mark × represents a case except for that. In this connection, items having no relation to the producing conditions are represented by mark ×.

Concerning the measurement made by X-ray, a sample was machined on a face parallel with a face of a steel sheet at a position of ¼ of the thickness, and thus obtained measurement value was used as a central value. In this connection, in order to provide the substantially the same mechanical property as that of the cold-rolled sheet to the hot-rolled steel sheet, several hot-rolled steel sheets (H, J, K, R, U, V, W and X) were additionally heat-treated for a short period of time at 700 to 850° C., and then the cooling condition was controlled.

In all the types of steel shown on Table 2, the types of steel, to which the numbers of "−2" and "−3" are attached, are of the present invention. When the types of steel, to which the numbers of "−2" and "−3" are attached, are compared with the types of steel, to which the numbers of "−1" and "4" are attached, which are not of the present invention, the quantities of spring-back in the types of steel of the present invention, the ratio {200}/{222} of X-ray diffraction intensity of which is not lower than 1.0, are smaller than the quantities of spring-back in the types of steel out of the present invention, the ratio {200}/{222} of X-ray diffraction intensity of which is lower than 1.0. That is, when the ratio {200}/{222} of X-ray diffraction intensity is not lower than 1.0, it is possible to accomplish the excellent shape fixability of a thin steel sheet.

The mechanism by which the shape fixability can be enhanced in bending when the ratio {200}/{222} of X-ray diffraction intensity is high is not clear at present. However, the cause is considered to be as follows. When this ratio {200}/{222} is high, the ratio of {100}/{111} is high. This means that the bending deformation proceeds by a relatively simple slip on {100} planes which are parallel with a face of a steel sheet. On the other hand, the bending deformation proceeds by a complicated action, in which a plurality of slip systems are entangled with each other, on {111} planes. That is, the cause can be understood as follows. When the ratio {100}/{111} is increased, it is possible to make the slip proceed easily in the process of bending deformation. As a result, the quantity of spring-back can be decreased in the process of bending deformation.

TABLE 1

(Mass %)

| Type of steel | C | Si | Mn | P | S | Al | Ti | Nb | V | Cr | B | N |
|---|---|---|---|---|---|---|---|---|---|---|---|---|
| C | 0.031 | 0.01 | 0.19 | 0.014 | 0.013 | 0.043 | — | — | — | — | 0.0024 | 0.0025 |
| D | 0.029 | 0.02 | 0.18 | 0.011 | 0.011 | 0.053 | — | — | — | — | — | 0.0020 |
| E | 0.086 | 0.03 | 0.45 | 0.016 | 0.011 | 0.046 | — | — | — | — | — | 0.0046 |
| F | 0.089 | 0.02 | 0.75 | 0.021 | 0.015 | 0.048 | — | — | — | — | — | 0.0043 |
| G | 0.091 | 0.02 | 1.86 | 0.017 | 0.017 | 0.055 | — | — | — | — | — | 0.0035 |
| H | 0.069 | 0.02 | 1.65 | 0.015 | 0.015 | 0.055 | — | — | — | — | — | 0.0046 |

TABLE 1-continued (Mass %)

| Type of steel | C | Si | Mn | P | S | Al | Ti | Nb | V | Cr | B | N |
|---|---|---|---|---|---|---|---|---|---|---|---|---|
| I | 0.116 | 0.54 | 2.01 | 0.013 | 0.016 | 0.047 | — | — | — | — | — | 0.0035 |
| J | 0.132 | 0.64 | 2.15 | 0.020 | 0.012 | 0.038 | 0.058 | — | — | — | 0.024 | 0.0037 |
| K | 0.155 | 0.29 | 2.28 | 0.020 | 0.018 | 0.058 | — | — | — | — | — | 0.0028 |
| L | 0.163 | 0.59 | 2.58 | 0.019 | 0.008 | 0.045 | 0.048 | — | — | — | — | 0.0029 |
| M | 0.027 | 0.02 | 0.18 | 0.066 | 0.014 | 0.044 | — | — | — | — | — | 0.0043 |
| N | 0.049 | 0.02 | 0.73 | 0.091 | 0.008 | 0.51 | — | — | — | — | — | 0.0031 |
| R | 0.12 | 1.22 | 1.53 | 0.021 | 0.012 | 0.044 | — | — | — | — | — | 0.0024 |
| S | 0.18 | 1.25 | 2.02 | 0.015 | 0.011 | 0.039 | — | — | — | — | — | 0.0032 |
| T | 0.36 | 1.21 | 1.55 | 0.018 | 0.014 | 0.039 | — | — | — | — | — | 0.0021 |
| U | 0.13 | 1.05 | 1.55 | 0.013 | 0.005 | 0.494 | 0.025 | — | — | — | — | 0.0034 |
| V | 0.14 | 1.48 | 1.05 | 0.014 | 0.002 | 0.052 | — | — | — | 0.35 | — | 0.0035 |
| W | 0.13 | 1.32 | 1.15 | 0.007 | 0.001 | 0.043 | 0.021 | — | — | 0.25 | — | 0.0038 |
| X | 0.15 | 1.43 | 1.35 | 0.009 | 0.005 | 0.045 | 0.025 | — | 0.033 | 0.30 | — | 0.0037 |

TABLE 2

| | | | Mechanical characteristic value (1.40 mm) | | | | | |
|---|---|---|---|---|---|---|---|---|
| Type of steel | Classification of steel sheet | Existence of additional heat treatment | Yield point (MPa) | Tensile strength (MPa) | Elongation (%) | Ratio of X-ray diffraction intensity {200}/{222} | Quantity of spring-back (degree) | Classification of invention |
| C-1 | Cold roll | | 205 | 335 | 45 | 0.45 | 8.5 | Out of present invention |
| -2 | Cold roll | | 195 | 330 | 42 | 4.43 | 4.9 | Present invention |
| -3 | Hot roll | No | 205 | 335 | 42 | 5.28 | 5.2 | Present invention |
| -4 | Hot roll | No | 205 | 330 | 44 | 0.69 | 8.0 | Out of present invention |
| D-1 | Cold roll | | 195 | 330 | 46 | 0.36 | 8.4 | Out of present invention |
| -2 | Cold roll | | 185 | 325 | 43 | 3.98 | 5.0 | Present invention |
| -3 | Hot roll | No | 200 | 335 | 43 | 6.35 | 5.3 | Present invention |
| -4 | Hot roll | No | 195 | 330 | 45 | 0.77 | 7.9 | Out of present invention |
| E-1 | Cold roll | | 290 | 400 | 40 | 0.59 | 8.5 | Out of present invention |
| -2 | Cold roll | | 285 | 395 | 37 | 3.43 | 6.2 | Present invention |
| -3 | Hot roll | No | 280 | 390 | 37 | 4.76 | 5.9 | Present invention |
| -4 | Hot roll | No | 295 | 405 | 39 | 0.87 | 8.4 | Out of present invention |
| G-1 | Cold roll | | 435 | 620 | 27 | 0.79 | 15.2 | Out of present invention |
| -2 | Cold roll | | 425 | 620 | 26 | 5.22 | 11.0 | Present invention |
| -3 | Hot roll | No | 445 | 615 | 25 | 4.41 | 10.8 | Present invention |
| -4 | Hot roll | No | 455 | 620 | 29 | 0.55 | 13.6 | Out of present invention |
| H-1 | Cold roll | | 355 | 625 | 32 | 0.88 | 14.0 | Out of present invention |
| -2 | Cold roll | | 345 | 590 | 30 | 6.04 | 10.9 | Present invention |
| -3 | Hot roll | Yes | 365 | 605 | 30 | 5.33 | 11.0 | Present invention |
| -4 | Hot roll | Yes | 345 | 615 | 31 | 0.61 | 13.5 | Out of present invention |
| J-1 | Cold roll | | 485 | 815 | 23 | 0.55 | 19.1 | Out of present invention |
| -2 | Cold roll | | 490 | 825 | 21 | 2.95 | 16.1 | Present invention |
| -3 | Hot roll | Yes | 515 | 805 | 20 | 3.65 | 15.9 | Present invention |
| -4 | Hot roll | Yes | 510 | 820 | 22 | 0.78 | 20.2 | Out of present invention |
| K-1 | Cold roll | | 635 | 1055 | 18 | 0.64 | 24.2 | Out of present invention |
| -2 | Cold roll | | 635 | 1050 | 17 | 3.85 | 21.0 | Present invention |
| -3 | Hot roll | Yes | 655 | 990 | 17 | 2.63 | 21.2 | Present invention |
| -4 | Hot roll | Yes | 650 | 1060 | 19 | 0.68 | 23.5 | Out of present invention |
| M-1 | Cold roll | | 245 | 365 | 43 | 0.35 | 8.1 | Out of present invention |
| -2 | Cold roll | | 235 | 355 | 41 | 4.64 | 5.0 | Present invention |
| -3 | Hot roll | No | 235 | 345 | 41 | 5.00 | 5.2 | Present invention |
| -4 | Hot roll | No | 240 | 355 | 43 | 0.75 | 8.3 | Out of present invention |
| N-1 | Cold roll | | 305 | 465 | 38 | 0.48 | 10.2 | Out of present invention |
| -2 | Cold roll | | 305 | 450 | 36 | 4.52 | 7.5 | Present invention |
| -3 | Hot roll | No | 295 | 450 | 37 | 6.11 | 7.3 | Present invention |
| -4 | Hot roll | No | 305 | 465 | 39 | 0.85 | 9.8 | Out of present invention |
| R-1 | Cold roll | | 455 | 615 | 41 | 0.62 | 14.2 | Out of present invention |
| -2 | Cold roll | | 460 | 625 | 39 | 5.48 | 11.0 | Present invention |
| -3 | Hot roll | Yes | 475 | 615 | 38 | 4.67 | 11.5 | Present invention |
| -4 | Hot roll | Yes | 470 | 625 | 40 | 0.52 | 14.3 | Out of present invention |
| U-1 | Cold roll | | 450 | 625 | 39 | 0.55 | 14.1 | Out of present invention |
| -2 | Cold roll | | 455 | 635 | 36 | 4.41 | 10.9 | Present invention |
| -3 | Hot roll | Yes | 465 | 625 | 37 | 5.32 | 9.7 | Present invention |
| -4 | Hot roll | Yes | 455 | 630 | 39 | 0.66 | 14.5 | Out of present invention |
| V-1 | Cold roll | | 465 | 635 | 40 | 0.76 | 14.5 | Out of present invention |
| -2 | Cold roll | | 455 | 620 | 37 | 3.46 | 10.7 | Present invention |
| -3 | Hot roll | Yes | 465 | 635 | 36 | 5.81 | 9.7 | Present invention |
| -4 | Hot roll | Yes | 460 | 635 | 39 | 0.85 | 15.2 | Out of present invention |

TABLE 2-continued

| Type of steel | Classification of steel sheet | Existence of additional heat treatment | Mechanical characteristic value (1.40 mm) Yield point (MPa) | Tensile strength (MPa) | Elongation (%) | Ratio of X-ray diffraction intensity {200}/{222} | Quantity of spring-back (degree) | Classification of invention |
|---|---|---|---|---|---|---|---|---|
| W-1 | Cold roll | | 460 | 635 | 38 | 0.45 | 15.5 | Out of present invention |
| -2 | Cold roll | | 460 | 640 | 34 | 4.44 | 11.8 | Present invention |
| -3 | Hot roll | Yes | 475 | 635 | 35 | 5.45 | 11.7 | Present invention |
| -4 | Hot roll | Yes | 465 | 635 | 39 | 0.75 | 16.0 | Out of present invention |
| X-1 | Cold roll | | 470 | 645 | 38 | 0.77 | 15.2 | Out of present invention |
| -2 | Cold roll | | 465 | 635 | 36 | 4.19 | 11.5 | Present invention |
| -3 | Hot roll | Yes | 470 | 630 | 35 | 4.36 | 12.0 | Present invention |
| -4 | Hot roll | Yes | 470 | 640 | 38 | 0.85 | 15.8 | Out of present invention |

TABLE 3

| Type of steel | Classification of steel sheet | Hot rolling condition: Hot rolling temperature 1 | Hot rolling temperature 2 | Lubrication | Cold rolling and annealing condition: Cold rolling reduction | Annealing temperature | Classification of invention |
|---|---|---|---|---|---|---|---|
| C-1 | Cold roll | ○ | — | ○ | x | ○ | Out of present invention |
| -2 | Cold roll | ○ | — | ○ | ○ | ○ | Present invention |
| -3 | Hot roll | ○ | — | ○ | — | — | Present invention |
| -4 | Hot roll | ○ | — | x | — | — | Out of present invention |
| D-1 | Cold roll | ○ | — | ○ | ○ | x | Out of present invention |
| -2 | Cold roll | ○ | — | ○ | ○ | ○ | Present invention |
| -3 | Hot roll | ○ | — | ○ | — | — | Present invention |
| -4 | Hot roll | ○ | — | x | — | — | Out of present invention |
| E-1 | Cold roll | ○ | — | ○ | x | ○ | Out of present invention |
| -2 | Cold roll | ○ | — | ○ | ○ | ○ | Present invention |
| -3 | Hot roll | ○ | — | ○ | — | — | Present invention |
| -4 | Hot roll | ○ | — | x | — | — | Out of present invention |
| G-1 | Cold roll | ○ | — | x | ○ | ○ | Out of present invention |
| -2 | Cold roll | ○ | — | ○ | ○ | ○ | Present invention |
| -3 | Hot roll | — | ○ | ○ | — | — | Present invention |
| -4 | Hot roll | — | ○ | x | — | — | Out of present invention |
| H-1 | Cold roll | ○ | — | x | ○ | ○ | Out of present invention |
| -2 | Cold roll | ○ | — | ○ | ○ | ○ | Present invention |
| -3 | Hot roll | — | ○ | ○ | — | — | Present invention |
| -4 | Hot roll | — | ○ | x | — | — | Out of present invention |
| J-1 | Cold roll | ○ | — | ○ | x | ○ | Out of present invention |
| -2 | Cold roll | ○ | — | ○ | ○ | ○ | Present invention |
| -3 | Hot roll | — | ○ | ○ | — | — | Present invention |
| -4 | Hot roll | — | ○ | x | — | — | Out of present invention |
| K-1 | Cold roll | ○ | — | ○ | ○ | x | Out of present invention |
| -2 | Cold roll | ○ | — | ○ | ○ | ○ | Present invention |
| -3 | Hot roll | — | ○ | ○ | — | — | Present invention |
| -4 | Hot roll | — | ○ | x | — | — | Out of present invention |
| M-1 | Cold roll | ○ | — | x | ○ | x | Out of present invention |
| -2 | Cold roll | ○ | — | ○ | ○ | ○ | Present invention |
| -3 | Hot roll | — | ○ | ○ | — | — | Present invention |
| -4 | Hot roll | — | ○ | x | — | — | Out of present invention |
| N-1 | Cold roll | ○ | — | x | x | ○ | Out of present invention |
| -2 | Cold roll | ○ | — | ○ | ○ | ○ | Present invention |
| -3 | Hot roll | ○ | — | ○ | — | — | Present invention |
| -4 | Hot roll | ○ | — | x | — | — | Out of present invention |
| R-1 | Cold roll | ○ | — | ○ | x | ○ | Out of present invention |
| -2 | Cold roll | ○ | — | ○ | ○ | ○ | Present invention |
| -3 | Hot roll | ○ | — | ○ | — | — | Present invention |
| -4 | Hot roll | ○ | — | x | — | — | Out of present invention |
| U-1 | Cold roll | ○ | — | ○ | x | ○ | Out of present invention |
| -2 | Cold roll | ○ | — | ○ | ○ | ○ | Present invention |
| -3 | Hot roll | ○ | — | ○ | — | — | Present invention |
| -4 | Hot roll | ○ | — | x | — | — | Out of present invention |
| V-1 | Cold roll | ○ | — | ○ | x | ○ | Out of present invention |
| -2 | Cold roll | ○ | — | ○ | ○ | ○ | Present invention |
| -3 | Hot roll | ○ | — | ○ | — | — | Present invention |
| -4 | Hot roll | ○ | — | x | — | — | Out of present invention |
| W-1 | Cold roll | ○ | — | x | ○ | x | Out of present invention |
| -2 | Cold roll | ○ | — | ○ | ○ | ○ | Present invention |
| -3 | Hot roll | — | ○ | ○ | — | — | Present invention |

TABLE 3-continued

| Type of steel | Classification of steel sheet | Hot rolling condition: Hot rolling temperature 1 | Hot rolling temperature 2 | Lubrication | Cold rolling and annealing condition: Cold rolling reduction | Annealing temperature | Classification of invention |
|---|---|---|---|---|---|---|---|
| -4 | Hot roll | — | ○ | x | — | — | Out of present invention |
| X-1 | Cold roll | ○ | — | ○ | x | ○ | Out of present invention |
| -2 | Cold roll | ○ | — | ○ | ○ | ○ | Present invention |
| -3 | Hot roll | — | ○ | ○ | — | — | Present invention |
| -4 | Hot roll | — | ○ | x | — | — | Out of present invention |

INDUSTRIAL APPLICABILITY

As described in detail before, when the texture of a thin steel sheet is controlled, the bending formability is remarkably enhanced. According to the present invention, it is possible to provide a thin steel sheet having an excellent shape fixability in which a quantity of spring-back is small so that the thin steel sheet of the present invention can be applied to the forming in which the bending is mainly conducted. According to the present invention, it has become possible to apply a high-strength steel sheet to parts of an automobile to which it used to be difficult to apply the high-strength steel sheet because of the occurrence of a defective shape caused by spring-back. At present, in order to decrease the weight of an automobile, it is necessary to use a high-strength steel sheet for manufacturing the automobile. In these circumstances, when the high-strength steel sheet having an excellent shape fixability, in which the quantity of spring-back is very small, is applied to parts of an automobile, the weight of the automobile can be decreased. Therefore, the present invention can provide a very useful industrial effect.

What is claimed is:

1. A ferritic steel sheet having shape fixability characterized in that a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

2. A ferritic steel sheet having shape fixability, comprising: at least 0.027 to less than 0.05 mass % of C, 0.01 to 1.0 mass % of Si, 0.01 to 2.0 mass % of Mn, not more than 0.15 mass % of P, not more than 0.03 mass % of S, 0.01 to 0.1 mass % of Al, not more than 0.01 mass % of N, not more than 0.007 mass % of O, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

3. A ferritic steel sheet having shape fixability, comprising: at least 0.027 to less than 0.05 mass % of C, 0.01 to 1.0 mass % of Si, 0.01 to 2.0 mass % of Mn, not more than 0.15 mass % of P, not more than 0.03 mass % of S, 0.01 to 0.1 mass % of Al, not more than 0.01 mass % of N, not more than 0.007 mass % of O, further containing one or more of not more than 0.2 mass % of Ti, not more than 0.2 mass % of Nb and not more than 0.005 mass % of B, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

4. A ferritic steel sheet having shape fixability, comprising: at least 0.027 to less than 0.05 mass % of C, 0.01 to 1.0 mass % of Si, 0.01 to 2.0 mass % of Mn, not more than 0.15 mass % of P, not more than 0.03 mass % of S, 0.01 to 0.1 mass % of Al, not more than 0.01 mass % of N, not more than 0.007 mass % of O, further containing one or more of not more than 1.0 mass % of Mo, not more than 2.0 mass % of Cu and not more than 1.0 mass % of Ni, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

5. A ferritic steel sheet having shape fixability, comprising: at least 0.027 to less than 0.05 mass % of C, 0.01 to 1.0 mass % of Si, 0.01 to 2.0 mass % of Mn, not more than 0.15 mass % of P, not more than 0.03 mass % of S, 0.01 to 0.1 mass % of Al, not more than 0.01 mass % of N, not more than 0.007 mass % of O, further containing one or more of not more than 0.2 mass % of Ti, not more than 0.2 mass % of Nb and not more than 0.005 mass % of B, furthermore containing one or more of not more than 1.0 mass % of Mo, not more than 2.0 mass % of Cu and not more than 1.0 mass % of Ni, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

6. A ferritic steel sheet having shape fixability, comprising: 0.05 to 0.25 mass % of C, 0.01 to 2.5 mass % of Si, 0.01 to 2.5 mass % of Mn, not more than 0.15 mass % of P, not more than 0.03 mass % of S, 0.01 to 1.0 mass % of Al, not more than 0.01 mass % of N, not more than 0.007 mass % of O, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

7. A ferritic steel sheet having shape fixability, comprising: 0.05 to 0.25 mass % of C, 0.01 to 2.5 mass % of Si, 0.01 to 2.5 mass % of Mn, not more than 0.15 mass % of P, not more than 0.03 mass % of S, 0.01 to 1.0 mass % of Al, not more than 0.01 mass % of N, not more than 0.007 mass % of O, further containing one or more of not more than 0.2 mass % of Ti, not more than 0.2 mass % of Nb, not more than 0.2 mass % of V, not more than 1.0 mass % of Cr and not more than 0.005 mass % of B, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

8. A ferritic steel sheet having shape fixability, comprising: 0.05 to 0.25 mass % of C, 0.01 to 2.5 mass % of Si, 0.01 to 2.5 mass % of Mn, not more than 0.15 mass % of P, not more than 0.03 mass % of S, 0.01 to 1.0 mass % of Al, not more than 0.01 mass % of N, not more than 0.007 mass % of O, further containing one or more of not more than 1.0 mass % of Mo, not more than 2.0 mass % of Cu and not more than 1.0 mass % of Ni, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

9. A ferritic steel sheet having shape fixability, comprising: 0.05 to 0.25 mass % of C, 0.01 to 2.5 mass % of Si, 0.01 to 2.5 mass % of Mn, not more than 0.15 mass % of P, not more than 0.03 mass % of S, 0.01 to 1.0 mass % of Al, not more than 0.01 mass % of N, not more than 0.007 mass % of O, further containing one or more of not more than 0.2 mass % of Ti, not more than 0.2 mass % of Nb, not more than 0.2 mass % of V, not more than 1.0 mass % of Cr and not more than 0.005 mass % of B, furthermore containing one or more of not more than 1.0 mass % of Mo, not more than 2.0 mass % of Cu and not more than 1.0 mass % of Ni, the balance being Fe and inevitable impurities, wherein a ratio of presence of {100} planes parallel with a sheet surface to {111} planes is not less than 1.0, and TS×El, which represents a product of maximum tensile strength (TS) multiplied by rupture elongation (El) of the steel sheet, is at least 13,860 MPa %.

10. A method of producing a ferritic steel sheet having shape fixability according to one of claims 1 to 9, comprising the steps of: conducting hot-rolling on a slab having a composition to result in the ferritic steel sheet of one of claims 1 to 9 so that a total rolling reduction of 25% or more in the hot rolling conducted at a temperature range from a temperature not higher than 950° C. to a temperature not lower than transformation temperature $Ar_3$ and a coefficient of friction of 0.2 or less in the hot rolling conducted at a temperature not higher than 950° C.; completing the hot rolling at a temperature not lower than transformation temperature $Ar_3$; cooling the hot-rolled steel strip; and coiling the hot-rolled steel strip at a temperature not higher than critical temperature $T_0$ determined by the following expression:

$$T_0=-650.4\times C\ \%-50.6\times \text{Mneq}+894.3$$

where Mneq=Mn %+0.5×Ni %−1.49×Si %−1.05×Mo %−0.44×W %+0.37×Cr %+0.67×Cu %−23×P %+13×Al %.

11. A method of producing a ferritic steel sheet having shape fixability according to one of claims 1 to 9, comprising the steps of: conducting hot-rolling on a slab having a composition to result in the ferritic steel sheet of one of claims 1 to 9 so that a total rolling reduction of 25% or more in the hot rolling conducted at a temperature not higher than transformation temperature $Ar_3$ and not lower than recrystallization temperature and a coefficient of friction of 0.2 or less in the hot rolling conducted at a temperature not higher than the $Ar_3$; cooling the hot-rolled steel strip; and coiling the hot-rolled steel strip or additionally recovering and recrystallizing the hot-rolled steel strip.

12. A method of producing a ferritic steel sheet having shape fixability according to one of claims 1 to 9, comprising the steps of: conducting hot-rolling on a slab having a composition to result in the ferritic steel sheet of one of claims 1 to 9 so that a total rolling reduction of 25% or more in the hot rolling conducted at a temperature range from a temperature not higher than 950° C. to a temperature not lower than transformation temperature $Ar_3$ and a coefficient of friction of 0.2 or less in the hot rolling conducted at a temperature not higher than 950° C.; completing the hot rolling at a temperature not lower than transformation temperature $Ar_3$; cooling the hot-rolled steel strip; coiling the hot-rolled steel strip at a temperature not higher than critical temperature $T_0$ determined by the following expression; pickling the hot rolled steel strip; conducting cold-rolling on the steel strip at a rolling reduction lower than 80%; heating the cold-rolled steel strip in a temperature range from a temperature not lower than 600° C. to a temperature lower than transformation temperature $Ac_3$; and cooling the steel strip:

$$T_0=-650.4\times C\ \%-50.6\times \text{Mneq}+894.3$$

where Mneq=Mn %+0.5×Ni %−1.49×Si %−1.05×Mo %−0.44×W %+0.37×Cr %+0.67×Cu %−23×P %+13×Al %.

13. A method of producing a ferritic steel sheet having shape fixability according to one of claims 1 to 9, comprising the steps of: conducting hot-rolling on a slab having a composition to result in the ferritic steel sheet of one of claims 1 to 9 so that a total rolling reduction of 25% or more in the hot rolling conducted at a temperature not higher than the transformation temperature $Ar_3$ and not lower than the recrystallization temperature and a coefficient of friction of 0.2 or less in the hot rolling conducted at a temperature not higher than the $Ar_3$; cooling the hot-rolled steel strip; and coiling the hot-rolled steel strip or additionally recovering and recrystallizing the hot-rolled steel strip; pickling the hot rolled steel strip; conducting cold-rolling on the steel strip at a rolling reduction lower than 80%; heating the cold-rolled steel strip in a temperature range from a temperature not lower than 600° C. to a temperature lower than transformation temperature $Ac_3$; and cooling the steel strip.

14. A thin ferritic steel sheet having an excellent shape fixability according to one of claims 1 to 9, wherein the sheet surface is plated.

15. A method of producing a ferritic steel sheet having shape fixability according to claim 14, comprising the steps of: conducting hot-rolling on a slab having a composition to result in the ferritic steel sheet of one of claims 1 to 9 so that a total rolling reduction of 25% or more in the hot rolling conducted at a temperature range from a temperature not higher than 950° C. to a temperature not lower than transformation temperature $Ar_3$ and a coefficient of friction of 0.2 or less in the hot rolling conducted at a temperature not higher than 950° C.; completing the hot rolling at a temperature not lower than transformation temperature $Ar_3$; cooling the hot-rolled steel strip; coiling the hot-rolled steel strip at a temperature not higher than critical temperature $T_0$ determined by the following expression; and plating on the hot-rolled steel strip:

$$T_0=-650.4\times C\ \%-50.6\times \text{Mneq}+894.3$$

where Mneq=Mn %+0.5×Ni %−1.49×Si %−1.05×Mo %−0.44×W %+0.37×Cr %+0.67×Cu %−23×P %+13×Al %.

16. A method of producing a ferritic steel sheet having shape fixability according to claim 14, comprising the steps of: conducting hot-rolling on a slab having a composition to result in the ferritic steel sheet of one of claims 1 to 9 so that a total rolling reduction of 25% or more in the hot rolling conducted at a temperature not higher than transformation temperature $Ar_3$ and not lower than recrystallization temperature and a coefficient of friction of 0.2 or less in the hot rolling conducted at a temperature not higher than the $Ar_3$;

cooling the hot-rolled steel strip; coiling the hot-rolled steel strip or additionally recovering and recrystallizing the hot-rolled steel strip; and plating on the hot-rolled steel strip.

17. A method of producing a ferritic steel sheet having shape fixability according to claim 14, comprising the steps of: conducting hot-rolling on a slab having a composition to result in the ferritic steel sheet of one of claims 1 to 9 so that a total rolling reduction of 25% or more in the hot rolling conducted at a temperature range from a temperature not higher than 950° C. to a temperature not lower than transformation temperature $Ar_3$ and a coefficient of friction of 0.2 or less in the hot rolling conducted at a temperature not higher than 950° C.; completing the hot rolling at a temperature not lower than transformation temperature $Ar_3$; cooling the hot-rolled steel strip; coiling the hot-rolled steel strip at a temperature not higher than critical temperature $T_0$ determined by the following expression; pickling the hot rolled steel strip; conducting cold-rolling on the steel strip at a rolling reduction lower than 80%; heating the cold-rolled steel strip in a temperature range from a temperature not lower than 600° C. to a temperature lower than transformation temperature $Ac_3$; cooling the steel strip; and plating on the steel strip:

$$T_0=-650.4\times C\ \%-50.6\times \mathrm{Mneq}+894.3$$

where Mneq=Mn %+0.5×Ni %−1.49×Si %−1.05×Mo %−0.44×W %+0.37×Cr %+0.67×Cu %−23×P %+13×Al %.

18. A method of producing a ferritic steel sheet having shape fixability according to claim 14, comprising the steps of: conducting hot-rolling on a slab having a composition to result in the ferritic steel sheet of one of claims 1 to 9 so that a total rolling reduction of 25% or more in the hot rolling conducted at a temperature not higher than the transformation temperature $Ar_3$ and not lower than the recrystallization temperature and a coefficient of friction of 0.2 or less in the hot rolling conducted at a temperature not higher than transformation temperature $Ar_3$; cooling the hot-rolled steel strip; and coiling the hot-rolled steel strip or additionally recovering and recrystallizing the hot-rolled steel strip; pickling the hot rolled steel strip; conducting cold-rolling on the steel strip at a rolling reduction lower than 80%; heating the cold-rolled steel strip in a temperature range from a temperature not lower than 600° C. to a temperature lower than transformation temperature $Ac_3$; cooling the steel strip; and plating on the steel strip.

* * * * *